US008157929B2

(12) United States Patent
Yokoyama et al.

(10) Patent No.: US 8,157,929 B2
(45) Date of Patent: Apr. 17, 2012

(54) MAGNETIC SHIELDING MATERIAL, MAGNETIC SHIELDING COMPONENT, AND MAGNETIC SHIELDING ROOM

(75) Inventors: Shin-ichiro Yokoyama, Minato-ku (JP); Yasuyuki Ilda, Yasugi (JP); Hakaru Sasaki, Yasugi (JP); Yoji Ishikura, Yasugi (JP); Hiromitsu Itabashi, Kumagaya (JP); Masahiro Mita, Kumagaya (JP); Yoshiyuki Fujihara, Yasugi (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 12/526,881

(22) PCT Filed: Feb. 12, 2008

(86) PCT No.: PCT/JP2008/052265

§ 371 (c)(1),
(2), (4) Date: Aug. 12, 2009

(87) PCT Pub. No.: WO2008/099812

PCT Pub. Date: Aug. 21, 2008

(65) Prior Publication Data

US 2010/0047111 A1 Feb. 25, 2010

(30) Foreign Application Priority Data

Feb. 13, 2007 (JP) ..... 2007-032499

(51) Int. Cl.
*H01F 1/147* (2006.01)

(52) U.S. Cl. ..... 148/312; 420/458

(58) Field of Classification Search ..... None
See application file for complete search history.

(56) References Cited

U.S. PATENT DOCUMENTS

| | | | |
|---|---|---|---|
| 3,556,876 | A | 1/1971 | Pfeifer et al. |
| 3,657,025 | A | 4/1972 | Pfeifer |
| 4,935,201 | A | 6/1990 | Inoue et al. |
| 4,948,434 | A | 8/1990 | Inoue et al. |
| 5,135,586 | A | 8/1992 | Meguro et al. |
| 5,500,057 | A | 3/1996 | Inoue et al. |

FOREIGN PATENT DOCUMENTS

| | | |
|---|---|---|
| DE | 2146755 | 3/1973 |
| EP | 0407608 A1 | 1/1991 |
| EP | 1197569 A1 | 4/2002 |

(Continued)

OTHER PUBLICATIONS

Hansen, Constitution of Binary Alloys, 1958, pp. 677 to 684.*

(Continued)

*Primary Examiner* — John P Sheehan
(74) *Attorney, Agent, or Firm* — Sughrue Mion, PLLC

(57) ABSTRACT

Disclosed are: a magnetic shielding material having excellent magnetic shielding property at a low magnetic field; and a magnetic shielding component and a magnetic shielding room each using the magnetic shielding material. Specifically disclosed is a magnetic shielding material comprising the following components (by mass): Ni: 70.0-85.0%, Cu: 0.6% or less, Mo: 10.0% or less and Mn: 2.0% or less, with the remainder being substantially Fe. The magnetic shielding material has a relative magnetic permeability of 40,000 or more under a magnetic field of 0.05 A/m and a squareness ratio ($Br/B_{0.8}$) of 0.85 or less, wherein the squareness ratio ($Br/B_{0.8}$) is a ratio of a remanent magnetic flux density (Br) to a maximum magnetic flux density ($B_{0.8}$) in a DC hysteresis curve produced under the maximum magnetic field of 0.8 A/m.

6 Claims, 3 Drawing Sheets

FOREIGN PATENT DOCUMENTS

| | | | |
|---|---|---|---|
| JP | 51-009019 | A | 1/1976 |
| JP | 57-034311 | A | 2/1982 |
| JP | 59-143037 | A | 8/1984 |
| JP | 64-042547 | A | 2/1989 |
| JP | 02-111838 | A | 4/1990 |
| JP | 03-075327 | A | 3/1991 |
| JP | 3-122236 | | 5/1991 |
| JP | 3-122237 | | 5/1991 |
| JP | 04-006249 | A | 1/1992 |
| JP | 04-141537 | A | 5/1992 |
| JP | 04-141538 | A | 5/1992 |
| JP | 07-188817 | A | 7/1995 |
| JP | 2002-161328 | A | 6/2002 |
| JP | 2002-266017 | A | 9/2002 |
| JP | 2006-233284 | A | 9/2006 |
| JP | 2007-146208 | A | 6/2007 |

OTHER PUBLICATIONS

European Search Report for 08711129.0 dated Oct. 5, 2010.

* cited by examiner

MAGNETIC SHIELDING MATERIAL, MAGNETIC SHIELDING COMPONENT, AND MAGNETIC SHIELDING ROOM

CROSS REFERENCE TO RELATED APPLICATION

This application is a National Stage of International Application No. PCT/JP2008/052265 filed Feb. 12, 2008, claiming priority based on Japanese Patent Application No. 2007-032499, filed Feb. 13, 2007, the contents of all of which are incorporated herein by reference in their entirety.

TECHNICAL FIELD

The present invention relates to a magnetic shielding material used for magnetic shielding under a low magnetic field, such as magnetic shielding room building materials for semiconductor manufacturing equipments or precision medical instruments, a magnetic shielding component, and a magnetic shielding room.

BACKGROUND ART

Conventionally, there have been used Ni—Fe alloys, typified by JIS PC permalloy, having a high magnetic permeability, and soft magnetic materials which are of modifications of the Ni—Fe alloys further containing additive Mo or Cu, and having further improved magnetic permeability.

Also, with a view to materializing a further high magnetic permeability, there has been proposed a soft magnetic material, which has a high magnetic permeability being of a relative magnetic permeability exceeding 250,000 under a magnetic field of 0.4 A/m being defined as an initial, relative magnetic permeability in JIS C2531, and which can be obtained by adjusting quantities of not only main components of the material but also impurities such as B, N, etc. in appropriate ranges and further controlling an atmosphere and a cooling rate in appropriate ranges when conducting final heat treatment (see, for example, JP-A-3-75327).

This proposal is of an excellent technology in the point that the magnetic permeability of a soft magnetic material, which has a great influence on a magnetic shielding property, is improved.

DISCLOSURE OF INVENTION

Problems to be Solved by the Invention

The present inventors made an examination to clarify that while the soft magnetic material disclosed in JP-A-3-75327 mentioned above and having a high magnetic permeability exhibits a high relative magnetic permeability exceeding 250,000 under a magnetic field of 0.4 A/m defined as an initial, relative magnetic permeability in JIS C2531, it is decreased in relative magnetic permeability in a lower magnetic field level.

Therefore, when such a soft magnetic material is used for the purpose of magnetic shielding in a very low magnetic environment such as geomagnetism, it has been found that its shielding effect is low. Thus, it became apparent that an important problem is involved in materializing a soft magnetic material for uses, in which a magnetic shielding property is required under a low magnetic field, such as magnetic shielding room building materials for semiconductor manufacturing equipments or precision medical instruments.

An object of the present invention is to solve the above problems whereby providing a magnetic shielding material having an excellent magnetic shielding property under a low magnetic field, a magnetic shielding component, and a magnetic shielding room each using the magnetic shielding material.

SUMMARY OF THE INVENTION

The present inventors defined a magnetic shielding material having an adjusted range of a chemical composition required to obtain a desired DC magnetic property, thereafter they examined relationships between a DC magnetic property of a magnetic shielding material and a magnetic shielding property under a very low magnetic field such as geomagnetism, etc. Consequently, it was found that a magnetic shielding performance excellent under a low magnetic field is obtained by adjusting a relative magnetic permeability of the magnetic shielding material under a further lower magnetic field than the magnetic field of 0.4 A/m (as defined in JIS C2531), which has been regarded as an index in the case where magnetic shielding is aimed at under a relatively high magnetic field, so as to be a prescribed value or more, and by adjusting a squareness ratio of a DC hysteresis curve to a predetermined value or less, whereby the present invention was attained.

Thus, the invention is directed to a magnetic shielding material which comprises, by mass, 70.0 to 85.0% of Ni, not more than 6.0% of Cu, not more than 10.0% of Mo and not more than 2.0% of Mn, and the balance being essentially Fe, and which has a relative magnetic permeability (μr) of 40,000 or more under a magnetic field of 0.05 A/m and a squareness ratio $Br/B_{0.8}$ of 0.85 or less, the squareness ratio being a ratio of a residual magnetic flux density (Br) to a maximum magnetic flux density ($B_{0.8}$) on a DC hysteresis curve under a maximum magnetic field of 0.8 A/m.

Desirably, the magnetic shielding material consists essentially of, by mass, 73.0 to 82.0% of Ni, 1.0 to 5.5% of Cu, 2.0 to 5.0% of Mo, 0.20 to 1.70% of Mn, and the balance of Fe and unavoidable impurities.

Also, according to the invention, the magnetic shielding material may contain, by mass, 2 to 200 ppm of Mg in addition to the above composition.

More desirably, the unavoidable impurities contained in the magnetic shielding material comprise, by mass, not more than 0.10% of C, not more than 1.0% of Si, not more than 0.02% of P, not more than 0.02% of S, not more than 0.01% of N, and not more than 0.01% of O.

The invention is directed to also a magnetic shielding component with use of the magnetic shielding material.

The invention is directed to also a magnetic shielding room with use of the magnetic shielding material.

The magnetic shielding material of the invention has an excellent magnetic shielding performance under a low magnetic field because of the high relative magnetic permeability and the low squareness ratio under a low magnetic field. Therefore, it is possible to obtain a magnetic shielding material being preferable in use for shielding in a low magnetic field such as geomagnetism.

Also, a magnetic shielding component and a magnetic shielding room each using the magnetic shielding material are preferred for shielding in a low magnetic field such as geomagnetism.

BEST MODE FOR CARRYING OUT THE INVENTION

Figure 1:
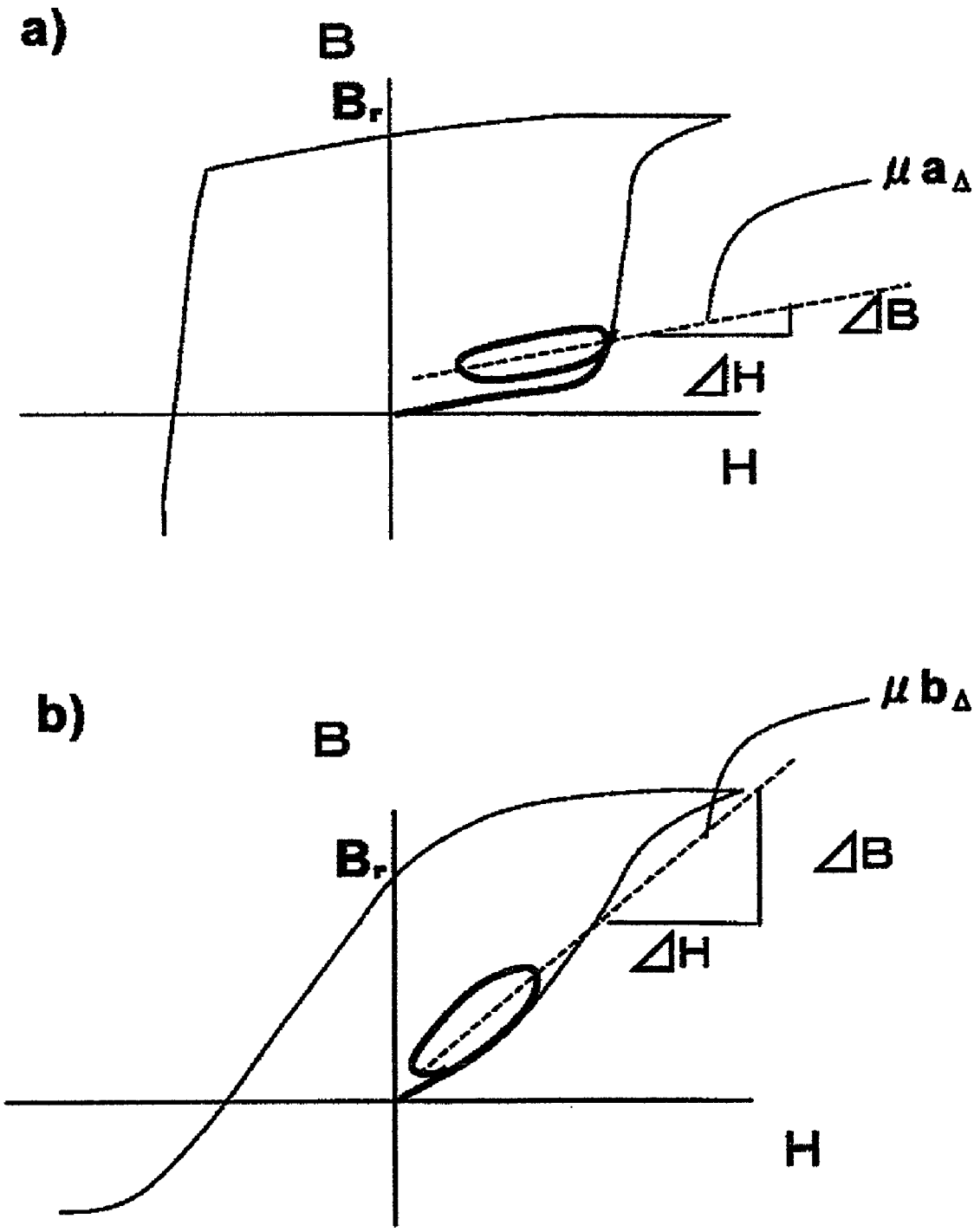
FIG. 1 is a schematic view showing the relationship between a squareness ratio and an incremental, magnetic permeability of a magnetic shielding material.

As set forth above, a key feature of the invention resides in verifying the relationship between magnetic properties and a magnetic shielding property of a magnetic shielding material to find that range of a magnetic property, in which an excellent magnetic shielding property exhibits itself under a very lower magnetic field, such as geomagnetism, etc., than a magnetic field of 0.4 A/m, which has been regarded as an index of a magnetic shielding property, and prescribing a range of chemical composition required for obtaining a desired magnetic property.

Herein below, there will be provided a description of reasons why respective chemical components of the invention magnetic shielding material is specified. Note that the quantity unit of the chemical components is "mass %" unless otherwise specified.

Ni: 70.0 to 85.0%

In the invention, Ni is an essential element in order to improve the magnetic shielding material in the magnetic permeability under a low magnetic field. Since the magnetic permeability is deteriorated in a Ni content range of less than 70.0% or more than 85.0%, the above content range of Ni is specified. Preferably the lower content limit of Ni is 73.0%, more preferably 75.0%. Also, the upper content limit of Ni is preferably 82.0%, more preferably 80.0%.

Cu: not more than 6.0%

Like as Ni, Cu is an element effective in improving the magnetic permeability under a low magnetic field, so that it is an essential additive. When the Cu content exceeds 6.0%, however, the magnetic permeability is deteriorated, so that the upper content limit of Cu is set to be not more than 6.0%. The lower content limit of Cu is preferably 1.0%, and the upper content limit of Cu is preferably 5.5%.

Mo: not more than 10.0%

Like as Ni and Cu, Mo is an element effective in improving in the magnetic permeability under a low magnetic field, so that Mo is an essential additive. When the Mo content exceeds 10.0%, however, the material becomes very hard whereby deteriorated in workability, so that the Mo content is set to be not more than 10.0%. The lower content limit of Mo is more preferably 2.0%, and the upper content limit of Mo is preferably 5.0%.

Mn: not more than 2.0%

Mn is also an element effective in improving the magnetic permeability, by a small additive amount of the same, under a low magnetic field owing to addition of a small quantity thereof, so that Mn is an essential additive. When the Mn content exceeds 2.0%, however, the squareness ratio of the material increases, so that the Mn content is set to be not more than 2.0%. The lower content limit of Mn is more preferably 0.20%, and the upper content limit thereof is preferably 1.70%.

Mg: 2 to 200 ppm

Mg is an optional element in the invention material, and added in a content range of 2 to 200 ppm as occasion demands. Mg is added optionally in order to fix sulfur as an impurity element, which deteriorates hot workability of the material, in order to improve the hot workability of the material. However, even if the Mg content exceeds 200 ppm, it is not expectable to obtain a Mg effect of further improving the hot workability. Therefore, the upper content limit of Mg is set to be 200 ppm. In order to further surely obtain the effect of improving the hot workability, the content range of Mg is desirably 2 to 150 ppm, and more desirably 20 to 120 ppm.

Balance: essentially Fe

While the balance essentially consists of Fe, it is an indispensable element, and necessarily contained in the invention material in order to adjust the amounts of the components described above. In addition to Fe, the balance includes unavoidable impurities such as C, Si, P, S, N, O, and so on.

When such unavoidable impurities are contained in excess, deterioration in hot workability and adverse influences on a magnetic property and a magnetic shielding property under a low magnetic field result, so that the unavoidable impurities are preferably adjusted in the following ranges:

C≦0.10%, Si≦1.0%, P≦0.02%, S≦0.02%, N≦0.01%, and O≦0.01%.

A more preferable range is C≦0.03%, Si≦0.3%, P≦0.015%, S≦0.01%, N≦0.005%, and O≦0.005%.

Also, in addition to unavoidable impurities such as C, Si, P, S, N, O and so on, Al, Ti, Cr, Co and so on are unavoidably and occasionally contained in the material. The unavoidable impurities such as Al, Ti, Cr, Co and so on also preferably fall in that range, which does not have adverse influences on a magnetic property and a magnetic shielding property, and suffice to fall in, for example, the following range: Al≦0.02%, Ti≦0.1%, Cr≦0.2% and Co≦0.2%.

Next, an explanation will be given to the reason why the magnetic property of a magnetic shielding material is prescribed.

The reason why the relative magnetic permeability (μr) under a magnetic field of 0.05 A/m is made not less than 40,000 is that such a range provides for a property required to exhibit an excellent magnetic shielding property in a very low magnetic environment such as geomagnetism. More desirably, the relative magnetic permeability (μr) under a magnetic field of 0.05 A/m is not less than 50,000. In addition, an optimum value of a magnetic field for measurement of a magnetic permeability under a very low magnetic field such as geomagnetism, or the like is made 0.05 A/m.

Also, the reason why the squareness ratio $Br/B_{0.8}$ of a DC hysteresis curve is set to be in a range of not more than 0.85 is that the squareness ratio of a DC hysteresis curve in such a range is one being optimum for making a relative magnetic permeability under a low magnetic field not less than 40,000, and it is thought that an incremental, magnetic permeability in use under a magnetic field of weak fluctuation can be heightened by making the magnetic property of a magnetic shielding material in line with a DC hysteresis curve of a low squareness ratio.

In case of providing for shielding in a weak, alternating magnetic field, which fluctuates with time, such as geomagnetism, it is inferred that a minute fluctuation of magnetic field in a minor loop region is repeated on a magnetic shielding material as shown schematically in FIG. 1.

At this time, it is believed that for a material having a high squareness ratio, an incremental, magnetic permeability is decreased as shown in FIG. 1*a* since a minor loop becomes small in inclination.

On the other hand, for a material having a low squareness ratio as shown in FIG. 1*b*, an incremental, magnetic permeability is thought to be increased since a minor loop becomes large in inclination. It is believed that a difference between DC hysteresis curves shown in FIGS. 1*a* and 1*b* is generated due to a difference between the both in behaviors of magnetic domain rotation and domain wall motion in a process of magnetization and a difference between the both in magnetic anisotropy.

Phenomenally, an excellent magnetic shielding property under a low magnetic field is obtained by making $Br/B_{0.8}$ not more than 0.85, and for a squareness ratio, at which the squareness ratio $Br/B_{0.8}$ exceeds 0.85, it becomes difficult to heighten a relative magnetic permeability under a low magnetic field, due to a difference between behaviors of magnetic domain rotation and domain wall motion in a process of magnetization and influences of magnetic anisotropy. More desirably, $Br/B_{0.8}$ is not more than 0.80.

In order to make the magnetic property of a magnetic shielding material falling in the range as defined in the invention, it is preferred that using a magnetic shielding raw material adjusted to the chemical composition set forth above, cold rolling and annealing be carried out at least once or more after hot rolling. In this case, in order to heighten a magnetic permeability under a low magnetic field and to adjust a squareness ratio decreasingly, it will be effective to decrease a rolling reduction in one pass of cold rolling, or to further perform a final heat treatment in a hydrogen atmosphere of a high dew point.

Specifically, cold rolling with a rolling reduction of not less than 60% is carried out with use of a hot rolled sheet obtained in a process of hot rolling. With a rolling reduction of less than 60%, it becomes difficult to heighten a magnetic permeability under a low magnetic field and to adjust a squareness ratio decreasingly. In this case, a rolling reduction in the order of 5 to 20% is effective at each pass in one cold rolling.

Also, softening annealing in a process of cold rolling is not necessarily needed and when softening annealing is applied in a process of cold rolling, deterioration in magnetic permeability under a low magnetic field rather results. Therefore, it is preferable to omit softening annealing in a process of cold rolling.

Magnetic annealing carried out after finish cold rolling is preferably carried out, for example, at 1000 to 1300 C.°, for 0.5 to 3 hours, at a cooling rate of not more than 100 C.°/h, and in a reducing atmosphere of a dew point of not higher than −30 C.°. A takeout temperature the annealed material is preferably not higher than 350 C.°.

The thus obtained magnetic shielding material of the invention is excellent in magnetic shielding property under a low magnetic field to be suited to uses, in which a magnetic shielding property is needed under a low magnetic field, such as magnetic shielding room housing materials, etc. of semiconductor manufacturing apparatuses and precision medical equipment.

Herein below there will be provided a detailed description of embodiments of the invention.

Embodiment 1

Ingots (weight: 6 ton per ingot) having three types of chemical compositions shown in Table 1 were produced through vacuum melting. All the chemical compositions of the three ingot types fell in the range as defined in the invention.

TABLE 1

| | (mass %) | | | | | |
|---|---|---|---|---|---|---|
| No. | Ni | Cu | Mo | Mn | [Mg] | Balance |
| 1 | 75.99 | 4.96 | 3.98 | 1.52 | — | Fe and unavoidable impurities |

TABLE 1-continued

| | (mass %) | | | | | |
|---|---|---|---|---|---|---|
| No. | Ni | Cu | Mo | Mn | [Mg] | Balance |
| 2 | 76.41 | 5.08 | 3.94 | 1.50 | — | Fe and unavoidable impurities |
| 3 | 77.88 | 3.56 | 4.50 | 0.71 | 58 | Fe and unavoidable impurities |
| 4 | 78.11 | 3.45 | 4.36 | 0.68 | 51 | Fe and unavoidable impurities |

Note 1:
Quantities of unavoidable impurities C ≦ 0.10%, Si ≦ 1.0%, P ≦ 0.02%, S ≦ 0.02%, N ≦ 0.01%, and O ≦ 0.01%
Note 2:
A unit of the Mg content is ppm.

After hot forging, the respective ingots was subjected to hot rolling to provide hot rolled materials having a thickness of 5.5 mm for No. 1 and a thickness of 2.5 mm for Nos. 2 and 3. Using these hot rolled materials as starting materials, ten kinds in total of cold rolled materials were fabricated in respective processes of cold rolling shown in Table 2. A rolling reduction at each pass in one cold rolling was made 10%.

TABLE 2

| | Process | | | | | |
|---|---|---|---|---|---|---|
| | Hot rolled material | Intermediate cold rolling | | Continuous annealing | Final cold rolling | |
| | Sheet | | | | Final | Rolling |
| No. | thickness (mm) | Sheet thickness (mm) | Rolling reduction (%) | Temperature (° C.) | sheet thickness (mm) | reduction (%) |
| 1a | 5.5 | — | — | — | 2.0 | 63.6 |
| 1b | 5.5 | 1.0 | 81.8 | 1000 | 0.5 | 50.0 |
| 1c | 5.5 | 1.0 | 81.8 | 1000 | 0.4 | 60.0 |
| 1d | 5.5 | — | — | — | 1.0 | 81.8 |
| 2a | 2.5 | — | — | — | 1.0 | 60.0 |
| 3a | 2.5 | — | — | — | 1.0 | 60.0 |
| 4a | 6.0 | — | — | — | 2.4 | 60.0 |
| 4b | 6.0 | — | — | — | 2.0 | 67.0 |
| 4c | 6.0 | — | — | — | 1.5 | 75.0 |
| 4d | 6.0 | — | — | — | 1.0 | 83.0 |

Ring samples having an outside diameter of 45 mm and an inside diameter of 33 mm were cut out from the respective cold rolled materials.

Further, the respective cold rolled materials of No. 3a, No. 1b, and No. 1c were worked to be made cylindrical in shape and welded to fabricate cylindrical-shaped samples having an outside diameter of 90 mm and height of 640 mm. The ring samples and the cylindrical-shaped samples were subjected to hot rolling in a hydrogen atmosphere furnace through the hysteresis of being held at 1150 C.° for three hours→100 C.°/h→700 C.°→80 C.°/h→300 C.°, and then taken out at 300 C.° from the furnace to be cooled to the room temperature. The ring samples and the cylindrical-shaped samples, respectively, after heat treatment were evaluated with respect to magnetic property and magnetic shielding property.

After the respective ring samples were given winding composed of a primary winding of 50 turns and a secondary winding of 100 turns, a DC flux meter was used to measure DC hysteresis curves at the condition of a maximum applied magnetic field of 0.8 A/m. Relative magnetic permeabilities under a magnetic field of 0.05 A/m and under a magnetic field of 0.4 A/m were determined from initial magnetization curves on the DC hysteresis curves. The relative magnetic permeability under a magnetic field of 0.4 A/m was an initial, relative magnetic permeability prescribed in JIS C2531. Further, from the DC hysteresis curves thus obtained, a maximum magnetic flux density $B_{0.8}$ (T) and a residual magnetic flux density Br (T) were determined and then a squareness ratio $Br/B_{0.8}$ was determined.

Also, after a Gauss meter was used to measure a magnetic field Ho under a low magnetic field, which alternated at the condition of frequency of 2 Hz and a maximum applied magnetic field of 5 μT, a cylindrical-shaped sample surrounded the periphery of the Gauss meter and a magnetic field Hi leaking into the cylindrical-shaped sample was measured. Magnetic shielding rates S (=Ho/Hi) of the respective cylindrical-shaped samples were determined from values of Ho and Hi. It can be said that the higher a value of S, the more excellent a magnetic shielding property. Since a magnetic shielding property was influenced by a sheet thickness (wall thickness) of a sample, however, a comparison of magnetic shielding properties with respect to dominance could not be made only by a value of S in case of a comparison of samples having different sheet thicknesses as shown in Table 2.

Hereupon, a sheet thickness was standardized by the use of the following formula (1) and an equivalent, relative magnetic permeability $\mu_{eq}$ was determined. In the formula (1), D indicates an outside diameter (90 mm) of a cylindrical-shaped sample and t indicates a sheet thickness of each of samples.

$$\mu_{eq}=(S-1)\times D/t \quad (1)$$

Figure 2:
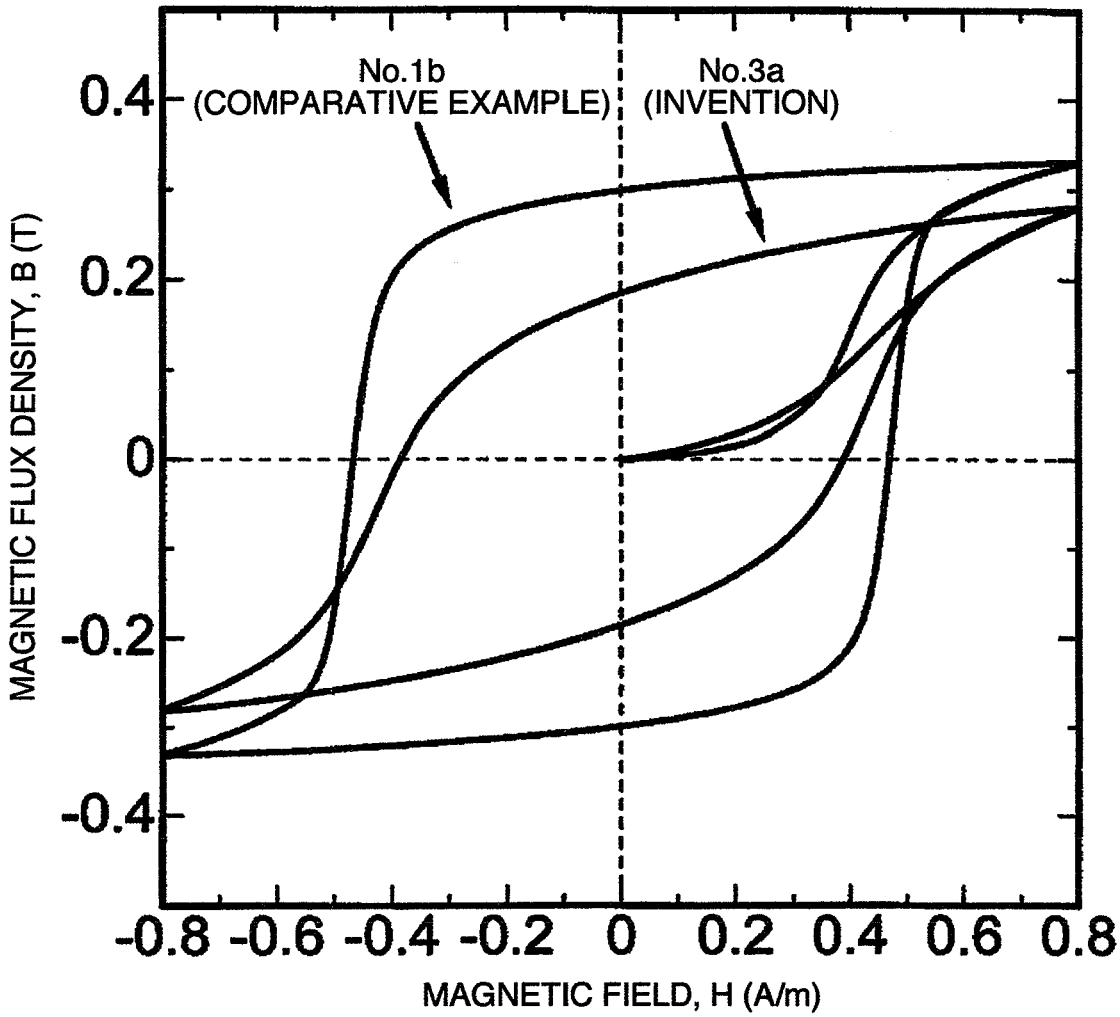
FIG. 2 shows DC hysteresis curves of a magnetic shielding material of the invention and a magnetic shielding material of a comparative example.

Table 3 synoptically shows evaluation results of the respective ring samples and the cylindrical-shaped samples. FIG. 2 shows DC hysteresis curves of No. 3a (the invention) and No. 1b (a comparative example) as evaluation examples of ring samples. Also, FIG. 3 shows a magnetic-field dependence of relative magnetic permeabilities obtained from initial magnetization curves of the DC hysteresis curves.

TABLE 3

| | Ring sample (mm) | | | Cylindrical-shaped sample | | |
|---|---|---|---|---|---|---|
| No. | Relative magnetic permeability $\mu_r$ (0.05 A/m) | Relative magnetic permeability $\mu_r$ (0.4 A/m) | Squareness ratio $Br/B_{0.8}$ | Shielding rate S | Equivalent, relative magnetic permeability μeq | Remarks |
| 1a | 74,600 | 234,600 | 0.69 | — | — | Invention |
| 2a | 61,900 | 238,000 | 0.76 | — | — | Invention |
| 3a | 70,800 | 211,600 | 0.66 | 700 | 63,000 | Invention |
| 1b | 30,900 | 269,800 | 0.90 | 150 | 26,000 | Comparative example |
| 1c | 26,400 | 150,300 | 0.90 | 100 | 20,000 | Comparative example |
| 1d | 62,100 | 312,600 | 0.77 | — | — | Invention |
| 4a | 61,500 | 112,500 | 0.56 | — | — | Invention |
| 4b | 83,700 | 150,600 | 0.61 | — | — | Invention |
| 4c | 86,200 | 168,700 | 0.60 | — | — | Invention |
| 4d | 87,800 | 174,900 | 0.60 | — | — | Invention |

Figure 3:
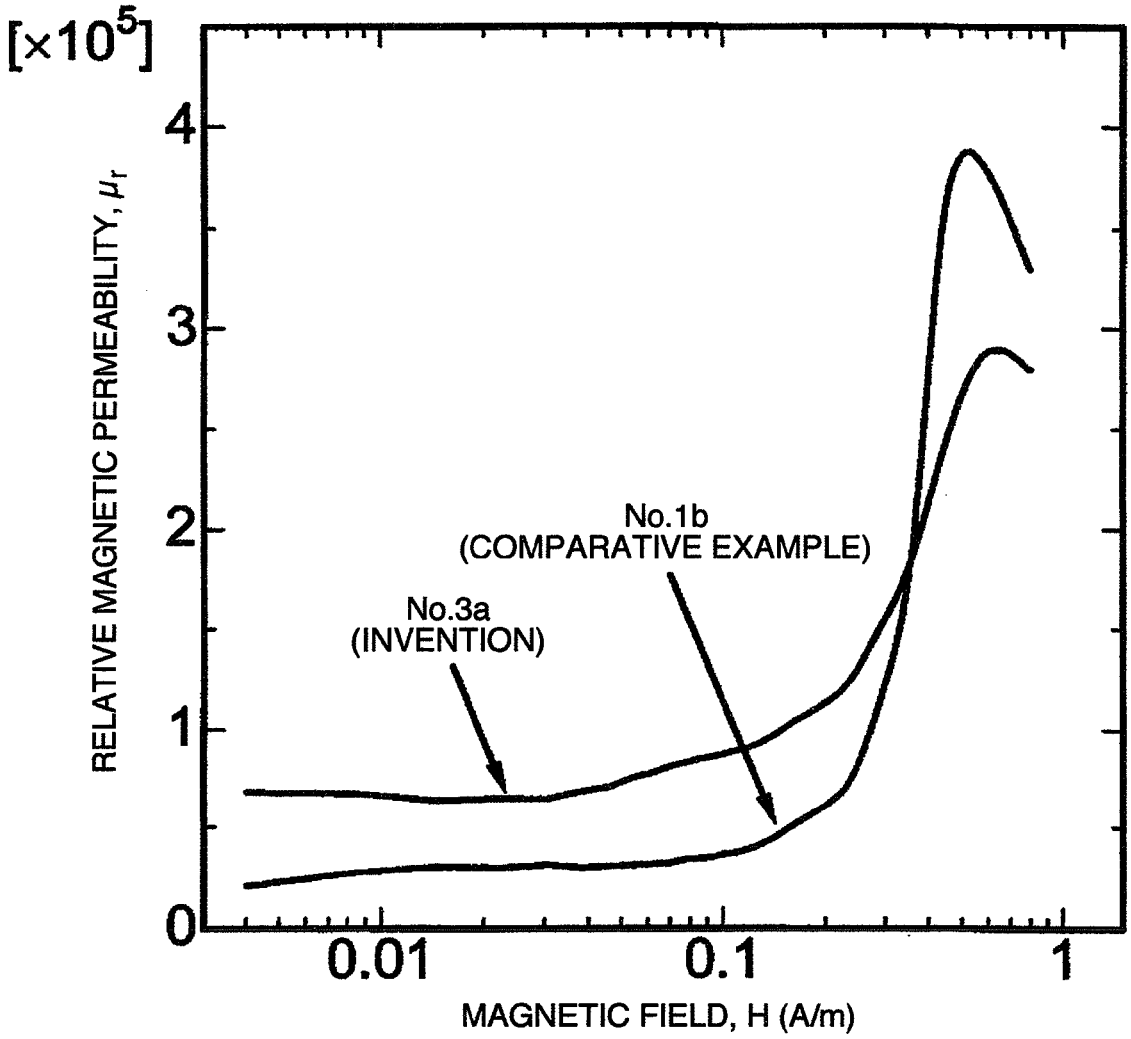
FIG. 3 is a graph showing magnetic-field dependences of a magnetic shielding material of the invention and a magnetic shielding material of a comparative example.

It is seen from Table 3 and FIGS. 2 to 3 that with No. 3a of the invention, in which the relative magnetic permeability μr under a magnetic field of 0.05 A/m was as high as 70,800 and the squareness ratio $Br/B_{0.8}$ was made as low as 0.66, an equivalent, relative magnetic permeability $\mu_{eq}$ of the cylindrical-shaped sample was as high as 63,000 to provide for an excellent magnetic shielding property.

On the other hand, with No. 1b of the comparative example, in which the relative magnetic permeability μr under a magnetic field of 0.05 A/m was as low as 30,900 and the squareness ratio $Br/B_{0.8}$ was as high as 0.90, the equivalent, relative magnetic permeability $\mu_{eq}$ of the cylindrical-shaped sample was as low as 26000 to be bad in magnetic shielding property while the relative magnetic permeability under a magnetic field of 0.04 A/m was higher than that of No. 2a. In this manner, it has become apparent that an excellent magnetic shielding property under a low magnetic field can be obtained by having the chemical composition and the magnetic property of a magnetic shielding material falling in the range prescribed in the invention.

From the above, a magnetic shielding component and a magnetic shielding room each using the magnetic shielding material of the invention are suited to shielding in a low magnetic field such as geomagnetism.

INDUSTRIAL APPLICABILITY

The magnetic shielding material of the invention is excellent in magnetic shielding property under a low magnetic field and so can be applied to uses, which need a magnetic shielding property under a low magnetic field such as magnetic shielding room housing materials of, for example, semiconductor manufacturing apparatuses and precision medical equipment.

The invention claimed is:

1. A magnetic shielding material for shielding geomagnetism, comprising, by mass, 70.0 to 85.0% of Ni, 1.0 to 6.0% of Cu, 2.0 to 10.0% of Mo and 0.2 to 2.0% of Mn, and the balance being essentially Fe, the magnetic shielding material having a relative magnetic permeability (μr) of 40,000 or more under a magnetic field of 0.05 A/m, a relative magnetic permeability of 112,500 or more under a magnetic field of 0.4 A/m, and a squareness ratio $Br/B_{0.8}$ of 0.80 or less, the squareness ratio being a ratio of a residual magnetic flux density (Br) to a maximum magnetic flux density ($B_{0.8}$) on a DC hysteresis curve under a maximum magnetic field of 0.8 A/m, and wherein the magnetic shielding material is produced by cold rolling where a total reduction of the cold rolling is not less than 60% and no annealing is performed between passes of the cold rolling.

2. The magnetic shielding material according to claim 1, comprising, by mass, 73.0 to 82.0% of Ni, 1.0 to 5.5% of Cu, 2.0 to 5.0% of Mo, 0.20 to 1.70% of Mn, and the balance of Fe and unavoidable impurities.

3. The magnetic shielding material, according to claim 2, further comprising, by mass, 2 to 200 ppm of Mg.

4. The magnetic shielding material, according to claim 2 or 3, wherein the unavoidable impurities comprise, by mass, not more than 0.10% of C, not more than 1.0% of Si, not more than 0.02% of P, not more than 0.02% of S, not more than 0.01% of N, and not more than 0.01% of O.

5. A magnetic shielding component comprising the magnetic shielding material according claim 1.

6. A magnetic shielding room comprising the magnetic shielding material according to claim 1.

* * * * *